United States Patent [19]

Wilsberg et al.

[11] Patent Number: 4,938,889

[45] Date of Patent: Jul. 3, 1990

[54] STORABLE BLEACH MIXTURE HAVING IMPROVED DISSOLVING POWER

[75] Inventors: Heinz-Manfred Wilsberg, Cologne; Rolf Puchta, Haan; Jochen Jacobs, Wuppertal, all of Fed. Rep. of Germany

[73] Assignee: Henkel Kommanditgesellschaft auf Aktien, Duesseldorf-Holthausen, Fed. Rep. of Germany

[21] Appl. No.: 323,180

[22] Filed: Mar. 15, 1989

Related U.S. Application Data

[63] Continuation of Ser. No. 121,260, Nov. 16, 1987, abandoned.

[30] Foreign Application Priority Data

Nov. 15, 1986 [DE] Fed. Rep. of Germany ..... 3639115

[51] Int. Cl.[5] ..... C11D 7/54; C11D 7/18; C11D 7/32

[52] U.S. Cl. ..... 252/102; 252/95; 252/99; 252/186.1; 252/186.38

[58] Field of Search ..... 252/95, 99, 102, 186.38, 252/186.1

[56] References Cited

U.S. PATENT DOCUMENTS

| | | | |
|---|---|---|---|
| 4,064,062 | 12/1977 | Yorko | 252/99 |
| 4,259,200 | 3/1981 | Sims | 252/102 |
| 4,290,903 | 9/1981 | Maegilp | 252/91 |
| 4,412,934 | 11/1983 | Chung | 252/186.38 |

*Primary Examiner*—Prince E. Willis
*Assistant Examiner*—Kathleen Markowski
*Attorney, Agent, or Firm*—Ernest G. Szoke; Wayne C. Jaeschke; Real J. Grandmaison

[57] ABSTRACT

A granular, storable bleach mixture suitable for addition to a detergent composition or to a wash liquor comprising a mixture of (a) from 5 to 35% by weight sodium perborate, preferably as monohydrate, (b) from 5 to 30% by weight tetra-acetyl ethylene-diamine and (c) from 90 to 50% by weight of a carrier material. The latter comprises a salt optionally containing water of crystallization or urea or mixtures thereof with anhydrous sodium sulfate, wherein the salt containing water of crystallization should not undergo any phase transformation between 1° C. and 45° C. In addition, the mixture may contain up to 15% of detergent constituents, such as surfactant and sequestering agent. The average particle size of the individual component is from 0.1 to 0.6 mm, less than 1% by weight being larger than 1.6 mm in size.

16 Claims, No Drawings

STORABLE BLEACH MIXTURE HAVING IMPROVED DISSOLVING POWER

This application is a continuation, of application Ser. No. 07/121,260, filed Nov. 16, 1987 now abandoned.

BACKGROUND OF THE INVENTION

1. Field of the Invention

This invention relates to a bleach mixture which may be added to a detergent composition or which may be additionally added to a wash liquor to enhance the bleaching effect, particularly at a temperature in the range from 30° C. to 60° C.

Known bleaches generally consist of a combination of a perhydrate, more especially sodium perborate, with a bleach activator, a bleach activator being understood to be a hydrolyzable compound which forms per-acids with the perhydrate in aqueous solution. Since mixtures of the two components react with one another even in the presence of small quantities of atmospheric moisture and thus suffer losses of activity, the powder particles of the individual components have to be spatially separated from one another, which may be done by mixing with relatively large amounts of powder-form extenders or diluents and/or by coating one or both components. Where the components are added to a detergent, the detergent itself may act as a release agent and extender. In that case, however, the user is no longer able to dose the bleach component individually as required or, for example in the washing of delicate fabrics, to dispense with a bleach component altogether.

2. Discussion of Related Art

The coating of one of the bleach components is a relatively involved process. In addition, individual coating materials can delay or complicate the dissolution and release of the bleach component in cold or moderately warm water. Further, it has been found that standard parting agents and extenders, for example sodium sulfate, sodium carbonate or disodium hydrogen phosphate, are attended by considerable disadvantages, irrespective of whether they are present in anhydrous, partially hydrated or completely hydrated form. The salt mixtures containing water of crystallization tend to cake when temperatures of 30° to 35° C. are reached or exceeded during storage or transport. Although mixtures free from water of crystallization are stable in storage, they tend to cake and clump in the dispensing compartment of standard domestic washing machines, with the result that residues are left in the dispensing compartments.

DESCRIPTION OF THE INVENTION

Other than in the operating examples, or where otherwise indicated, all numbers expressing quantities of ingredients or reaction conditions used herein are to be understood as modified in all instances by the term "about".

The present invention, through which the afore-mentioned disadvantages can be avoided, relates to a storable, powder-form bleach mixture having improved dissolving properties which contains a perhydrate, a bleach activator acting as a per-acid precursor and a water-soluble parting agent and extender, characterized in that it comprises an intimate mixture of the following constituents: (a) from 5 to 35% by weight of sodium perborate in the form of the monohydrate or tetrahydrate;

(b) from 5 to 30% by weight of tetra-acetyl ethylenediamine;

(c) from 90 to 50% by weight of at least one of the following water-soluble phosphate-free compounds;

(i) a salt free from or containing water of crystallization which does not undergo any phase transformation in the temperature range from 1° C. to 45° C., (ii) urea, (iii) a mixture of the substances mentioned in (i) and (ii) with anhydrous sodium sulfate up to a ratio by weight of more than 3:2, respectively, and (d) from 0 to 15% by weight of detergent constituents selected from the group consisting of synthetic surfactants and/or sequestering agents; with the proviso that the average particle size of constituents (a) to (c) is from 0.1 to 0.6 mm, and the proportion of particles larger than 1.6 mm in size is less than 1% by weight, based on the weight of said mixture.

The sodium perborate is preferably present in the form of the monohydrate in a quantity of preferably from 10 to 30% by weight, and more preferably from 15 to 25% by weight. Its average particle size is generally from 0.2 to 0.6 mm and the proportion of dust-form to fine-grained perborate having a particle size below 0.1 mm should be less than 5% by weight and preferably less than 1% by weight. The content of particles larger than 0.8 mm in size in the perborate used should be no more than 10% by weight and the content of particles larger than 1.6 mm in size no more than 1% by weight. Suitable particle fractions comprise a level of 85 to 100% of particles from 0.1 to 0.8 mm in size.

The tetra-acetyl ethylenediamine (TAED) is present in a quantity of from 5 to 30% by weight, preferably in a quantity of from 10 to 25% by weight, and more preferably in a quantity of from 15 to 23% by weight. Where the perborate is used as the tetrahydrate, the ratio by weight of TAED to perborate is best from 1:1 to 1:5. The ratio by weight of TAED to perborate monohydrate is best from 5:3 to 1:2 and preferably from 1.5:1 to 1:1.5. The average particle size of the TAED should preferably be no more than 0.5 mm and, more preferably, no more than 0.4 mm. The TAED used preferably contains less than 10% by weight of particles larger than 0.6 mm in size and less than 1% by weight of particles larger than 0.8 mm in size. So far as the content of fines, i.e. particles less than 0.1 mm in size, is concerned, there are no narrow limits; instead, such limits as apply are imposed solely by the processibility of these finely-divided products. This represents a particular advantage of the products according to the invention. In this way, it is also possible to use dustform batches or batches obtained from technical products by sifting off the fines. To preserve the stability of TAED-containing bleach mixtures, it has hitherto been considered necessary that the activator should advantageously be present in granulated, coarse-grained form in order to obtain high stability in storage. It has surprisingly been found, in the case of the mixtures according to the invention, that there is no need either for granulation or for the separation of dust-form TAED fractions. In addition, the very finely-divided TAED readily disperses in the wash liquor and, in contrast to coarse-grained particles, does not sink to the bottom of the washing container or the outer drum of the washing machine where it is no longer available for the bleaching process.

The TAED may also be present in granulated form providing these granulates consist of correspondingly fine-grained TAED and a readily water-soluble granulating agent, as described for example in European Pat. No. 0 037 026. In this case, the granulating agent consists of cellulose ether in a quantity of less than 10%, based on TAED granulate. In this case, it is of advantage to use a TAED granulate consisting of agglomerates from 0.01 mm to 0.8 mm, and preferably from 0.05 mm to 0.6 mm in size.

Component (c) may consist of water-soluble, phosphate-free salts which do not bind or release water of crystallization or melt at temperatures in the range from +1° C. to +45° C. Phosphate-free salts of this type include sodium chloride, sodium nitrate, sodium acetate trihydrate, borax and mixtures thereof. Urea is another suitable extender. In addition, the substances mentioned may be extended with anhydrous sodium sulfate up to a content of at most 40% by weight, and preferably up to a content of at most 30% by weight, based on the weight of the mixture of parting agent and extender. Larger contents of anhydrous sodium sulfate adversely affect the dispensability of the product and should therefore be avoided. Likewise, salts containing water of crystallization which undergo a phase transformation in the temperature range indicated, such as crystallized sodium sulfate and crystallized soda, lead to impaired powder properties and should therefore be avoided as additives.

Parting agents which have a solubility of more than 30 g/100 g water at 5° to 20° C. have proven to be particularly suitable. Parting agents such as these include in particular urea and sodium acetate trihydrate and also sodium chloride.

The average particle size of component (c) is advantageously between 0.1 mm and 0.6 mm, the proportion of particles larger than 1.6 mm and smaller than 0.01 mm in size being less than 2% by weight, and preferably less than 1% by weight in either case.

The bleach mixtures are prepared simply by mixing the constituents, the TAED and perborate monohydrate advantageously not being directly mixed with one another without the presence of the parting agents and extender. The 3 components are best mixed simultaneously in a single operation or one of components (a) and (b) is mixed with component (c) and the missing component subsequently added. Mixing may be carried out continuously or in batches using standard mechanical mixing machines.

The optional component (d) may consist of known anionic and nonionic surfactants of the sulfonate type, the sulfate type and the polyglycol ether adduct type, for example alkylbenzene sulfonates containing linear $C_{10}$–$C_{13}$ alkyl radicals, α-sulfofatty acids and α-sulfofatty acid esters containing from 12 to 18 carbon atoms in the fatty acid residue, $C_{12}$–$C_{18}$ alkane sulfonates and also ethoxylates of linear or methyl-branched alcohols containing from 12 to 18 carbon atoms and from 2 to 20 ethylene glycol ether groups. Suitable sequestering agents include, in particular, phosphonic acids containing amino groups in the form of their water-soluble salts, such as aminotri-(methylene phosphonic acid), ethylenediamine tetra-(methylene phosphonic acid), diethylenetriamine penta-(methylene phosphonic acid) and higher homologs thereof. They are normally present as sodium salts. Other suitable sequestering agents include homopolymers and copolymers of acrylic, methacrylic and maleic acid, for example, an acrylic acid/maleic acid copolymer in a ratio of 5:1 to 1:1, which are also generally present in the form of the sodium salts. The proportion of surfactants may be, for example, from 0 to 12% by weight, and the proportion of sequestering agents from 0 to 3% by weight. The average particle size of the optional constituents best corresponds to the average particle size of constituents (a) to (c). These additives can enhance the cleaning power and to a certain extent, in the case of the sequestering agents, the storability of the mixtures. They have no significant effect upon dispensability.

The mixtures according to the invention are distinguished by high stability in storage and, in particular, by very good and residue-free dispensing in standard domestic washing machines. The dispensed bleach activator disperses and dissolves very quickly and uniformly in the wash liquor and thus guarantees a good bleaching result.

EXAMPLES

The following constituents, in % by weight, were mixed in a mixer equipped with rotating plough blades:

| Constituent | Examples 1 | Examples 2 | Comparison A | Comparison B |
|---|---|---|---|---|
| Urea | 61 | 41 | — | 21 |
| Sodium sulfate, anhydrous | — | 20 | 61 | 40 |
| TAED | 19 | 19 | 19 | 19 |
| $NaBO_3.H_2O$ | 20 | 20 | 20 | 20 |

Particle size analysis (> means larger than, < smaller than)

| | >1.6 | >0.8 | >0.4 | >0.2 | >0.1 | <0.1 mm |
|---|---|---|---|---|---|---|
| Urea | — | 0.3 | 9.4 | 39.3 | 33.5 | 17.5 |
| Sodium sulfate | — | 0.4 | 7.9 | 36.4 | 36.1 | 19.3 |
| TAED | — | 0.1 | 11.3 | 58.1 | 24.9 | 5.6 |
| $NaBO_3.H_2O$ | — | 0.1 | 42.1 | 55.4 | 2.2 | 0.1 |

The mixtures had the following powder densities: Example 1=645 g/l; Example 2=640 g/l; Comparison A=600 g/l; Comparison B=590 g/l.

The dry mixtures flowed freely and suffered no loss of activity after storage in their packed state for 6 weeks at 20 ° to 35° C.

The dispensing behavior of the bleach was tested in a domestic washing machine (ZANUSSI 285). To this end, measured quantities of the bleach mixture and of a powder-form domestic detergent were placed in the dispensing compartment in various sequences and the machine switched on. The water supply was 10 liters (7.5 liters per minute). The material remaining in the dispensing compartment was then removed and reweighed. Test series A: 100 g domestic detergent poured in; Test series B: 100 g bleach poured in; Test series C: first 100 g detergent, then 33 g bleach poured in; Test series D: first 33 g bleach, then 100 g detergent poured in.

The following Table 1 shows the quantities of inflowing water after which complete dispensing was obtained and the quantity of substance in grams remaining in the dispensing compartment after the inflow of 10 liters of water. Each test was carried out 5 times and the average value determined. The results demonstrate the superiority of the mixtures according to the invention.

TABLE 1

| Example 1 | Example 2 |
|---|---|

TABLE 1-continued

| Test series | liters* | grams residue | liters* | grams residue |
|---|---|---|---|---|
| A | 2.5 | 0 | 2.5 | 0 |
| B | 4.5 | 0 | 6.5 | 0 |
| C | 3.0 | 0 | 3.0 | 0 |
| D | 3.4 | 0 | 5.2 | 0 |
| | Comparison A | | Comparison B | |
| | liters | grams residue | liters | grams residue |
| B | 10 | 29.3 | 10 | 15.0 |
| C | 10 | 19.3 | 10 | 2.0 |
| D | 10 | 24.4 | 10 | 12.1 |

*quantity of inflowing water after which all of the product(s) was dispensed.

We claim:

1. A storable, powder-form bleach mixture having improved dissolving power, consisting of an intimate mixture of:

(a) from about 5 to about 35% by weight of sodium perborate monohydrate;

(b) from about 5 to about 30% by weight of tetraacetyl ethylene-diamine;

(c) from about 90 to about 50% by weight of at least one of the following water-soluble compounds;

(i) urea, (ii) a mixture of urea and a phosphate-free salt which does not contain or release water of crystallization or melt in the temperature range from about 1° C. to about 45° C., (iii) a mixture of said compounds in (i) and (ii) with anhydrous sodium sulfate up to a ratio by weight of more than 3:2, respectively, and (d) from 0 to about 15% by weight of a detergent constituent consisting of a synthetic surfactant or sequestering agent; with the proviso that the average particle size of constituents (a) to (c) is from about 0.1 to about 0.6 mm, and the proportion of particles larger than about 1.6 mm in size is less than about 1% by weight, based on the weight of said mixture.

2. A mixture as in claim 1 wherein said constituent (a) is present in a quantity of from about 10 to about 30% by weight.

3. A mixture as in claim 1 wherein said constituent (b) is present in a quantity of from about 10 to about 25% by weight.

4. A mixture as in claim 1 wherein the ratio by weight of sodium perborate monohydrate to constituent (b) is from about 5:3 to about 1:2.

5. A mixture as in claim 1 wherein said constituent (a) has an average particle size of from about 0.2 to about 0.6 mm, and the amount of said constituent (a) having a particle size below about 0.1 mm is less than about 5% by weight.

6. A mixture as in claim 1 wherein the amount of said constituent (a) having a particle size larger than about 0.8 mm is no more than about 10% by weight.

7. A mixture as in claim 1 wherein said constituent (b) has an average particle size of no more than about 0.5 mm.

8. A mixture as in claim 1 wherein said constituent (b) contains less than about 10% by weight of particles larger than about 0.6 mm in size, and less than about 1% by weight of particles larger than about 0.8 mm in size.

9. A mixture as in claim 1 wherein said phosphate-free salt in the mixture of (ii) of constituent (c) is selected from the group consisting of sodium chloride, sodium nitrate, sodium acetate trihydrate, borax, and mixtures thereof.

10. A mixture as in claim 1 wherein said constituent (c) consists of mixtures of urea with anhydrous sodium sulfate wherein the maximum sodium sulfate content is about 30% by weight, based on constituent (c).

11. A mixture as in claim 1 wherein said constituent (c) has a solubility of more than about 30 g/100 g water at about 5° to about 20° C.

12. A mixture as in claim 1 wherein said constituent (d) is selected from the group consisting of an anionic surfactant and a nonionic surfactant.

13. A mixture as in claim 1 wherein said constituent (d) consists of a phosphonic acid containing an amino group in the form of its water-soluble salt.

14. A storable, powder-form bleach mixture having improved dissolving power consisting of an intimate mixture of:

(a) from about 10 to about 30% by weight of sodium perborate monohydrate;

(b) from about 10 to about 25% by weight of tetraacetyl ethylene-diamine; and (c) from about 90 to about 50% by weight of at least one of the following water-soluble compounds;

(i) urea, (ii) a mixture of urea and a phosphate-free salt which does not contain or release water of crystallization or melt in the temperature range from about 1° C., (iii) a mixture of said compounds in (i) and (ii) with anhydrous sodium sulfate up to a ratio by weight of more than 3:2, respectively; with the proviso that the average particle size of constituents (a) to (c) is from about 0.1 to about 0.6 mm, and the proportion of particles larger than about 1.6 mm in size is less than about 1% by weight, based on the weight of said mixture.

15. A mixture as in claim 14 wherein said constituent (a) has an average particle size of from about 0.2 to about 0.6 mm, and said constituent (b) has an average particle size of no more than about 0.5 mm.

16. A storable, powder-form bleach mixture having improved dissolving power consisting of an intimate mixture of:

(a) from about 15 to about 25% by weight of sodium perborate monohydrate;

(b) from about 10 to about 25% by weight of tetraacetyl ethylene-diamine; and (c) from about 90 to about 50% by weight of at least one of the following water-soluble compounds;

(i) urea, (ii) a mixture of urea and a phosphate-free salt which does not contain or release water of crystallization or melt in the temperature range from about 1° C. to about 45° C.

(iii) a mixture of said compounds in (i) and (ii) with anhydrous sodium sulfate up to a ratio by weight of more than 3:2, respectively; with the proviso that the average particle size of constituents (a) to (c) is from about 0.1 to about 0.6 mm and the proportion of particles larger than about 1.6 mm in size is less than about 1% by weight, based on the weight of said mixture.

* * * * *